US008518621B2

(12) United States Patent
Kunii et al.

(10) Patent No.: US 8,518,621 B2
(45) Date of Patent: Aug. 27, 2013

(54) TONER FOR ELECTROSTATIC IMAGE DEVELOPMENT

(75) Inventors: Satoshi Kunii, Wakayama (JP); Masahito Yamazaki, Wakayama (JP); Yoshihiro Fukushima, Wakayama (JP)

(73) Assignee: Kao Corporation, Nihonbashi (JP)

( * ) Notice: Subject to any disclaimer, the term of this patent is extended or adjusted under 35 U.S.C. 154(b) by 699 days.

(21) Appl. No.: 12/689,531

(22) Filed: Jan. 19, 2010

(65) Prior Publication Data

US 2010/0203440 A1 Aug. 12, 2010

(30) Foreign Application Priority Data

Feb. 9, 2009 (JP) ..... 2009-027824

(51) Int. Cl.
*G03G 9/087* (2006.01)

(52) U.S. Cl.
USPC ..... 430/108.1; 430/108.6; 430/108.7; 430/109.1; 430/109.3; 430/109.4; 430/111.4

(58) Field of Classification Search
USPC ..... 430/108.1, 108.6, 108.7, 109.1, 109.3, 430/109.4, 111.4
See application file for complete search history.

(56) References Cited

U.S. PATENT DOCUMENTS

| | | | |
|---|---|---|---|
| 7,235,337 | B2 | 6/2007 | Kameyama et al. |
| 2009/0280426 | A1 | 11/2009 | Kunii et al. |
| 2009/0280427 | A1 | 11/2009 | Kunii et al. |
| 2010/0075242 | A1 | 3/2010 | Kunii et al. |

FOREIGN PATENT DOCUMENTS

| | | | |
|---|---|---|---|
| JP | 55-60960 | A | 5/1980 |
| JP | 63-68853 | | 3/1988 |
| JP | 2-264970 | A | 10/1990 |
| JP | 10-221879 | | 8/1998 |
| JP | 2000-275911 | A | 10/2000 |
| JP | 2003-35973 | A | 2/2003 |
| JP | 2005-37926 | | 2/2005 |
| JP | 2007-293327 | A | 11/2007 |
| JP | 2008-122931 | | 5/2008 |

OTHER PUBLICATIONS

Office Action issued Nov. 19, 2012 in Japanese Patent Application No. 2009-027824 (with English-language translation).

*Primary Examiner* — Hoa V Le
(74) *Attorney, Agent, or Firm* — Oblon, Spivak, McClelland, Maier & Neustadt, L.L.P.

(57) ABSTRACT

A toner for electrostatic image development containing a resin binder, a negatively chargeable charge control agent, and a positively chargeable charge control agent, wherein the resin binder contains at least one polyester, wherein a carboxylic acid component of the polyester contains isophthalic acid and/or an ester thereof and fumaric acid and/or an ester thereof, provided that if two or more polyesters are used, the carboxylic acid component is taken as an overall component, and wherein the negatively chargeable charge control agent contains a metal-containing azo dye and/or a metal complex of salicylic acid, and wherein the toner has a softening point of from 90° to 120° C. The toner for electrostatic image development of the present invention can be suitably used in developing latent images formed in, for example, electrophotography, an electrostatic recording method, an electrostatic printing method, or the like.

15 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like, and a method of forming fixed images using the toner.

BACKGROUND OF THE INVENTION

With the growth of print-on-demand market in the recent years, the demands for speeding up for electrophotographic techniques are ever more increasing. In view of the above, as a means for meeting the requirement of speeding up, a toner in which a polyester is used as a resin binder is used in order to fuse the toner on paper with less energy. However, if the toner as described above is used in printing for a long period of time in order to meet the requirement of speeding up, there are some disadvantages, such as the triboelectric charges gradually increase and the image density is lowered.

In view of the above, in order to overcome these disadvantages, a method of stabilizing triboelectric charges by using a combination of a negatively chargeable charge control agent and a positively chargeable charge control agent is proposed (see JP-A-Sho-63-68853 and JP-A-Hei-10-221879). In addition, a method of stabilizing triboelectric charges by using a combination of a polyester obtained from fumaric acid having a smaller content of a low-molecular weight component, and positively and negatively chargeable charge control agents (see JP-A-2005-37926).

SUMMARY OF THE INVENTION

The present invention relates to:

[1] a toner for electrostatic image development containing
a resin binder,
a negatively chargeable charge control agent, and
a positively chargeable charge control agent, wherein the resin binder contains at least one polyester, wherein a carboxylic acid component of the polyester contains isophthalic acid and/or an ester thereof and fumaric acid/or an ester thereof, provided that if two or more polyesters are used, the carboxylic acid component is taken as an overall component, and wherein the negatively chargeable charge control agent contain a metal-containing azo dye and/or a metal complex of salicylic acid, and wherein the toner has a softening point of from 90° to 120° C.; and

[2] a method of forming fixed images including the step of applying the toner as defined in the above [1] to an apparatus for forming fixed images according to a non-contact fusing method.

DETAILED DESCRIPTION OF THE INVENTION

The present invention relates to a toner for electrostatic image development, having excellent smearing property (abrasion resistance), thereby making it possible to stably obtain excellent fixed images for printing over a long period of time, and a method of forming fixed images using the toner.

The toner for electrostatic image development of the present invention exhibits some effects that the toner has excellent triboelectric stability and transferability and is capable of maintaining a stable image density, thereby making it possible to stably obtain excellent fixed images, and shows excellent smearing property, even in printing at high speed and for a long period of time according to a non-contact fusing method.

These and other advantages of the present invention will be apparent from the following description.

In the print-on-demand printing, in the post treatments such as bookbinding after printing, preparation of catalogs, and preparation of postal mail items, a printout processing step with a mail sealer, a burster, a folding machine, a booklet finisher, a stapling finisher or the like is carried out after a fixing step of a toner; however, there are some disadvantages that a stress applied in this post treatment step is strong, and especially the papers are rubbed against each other, thereby lowering image quality.

Especially, in a non-contact thermally fusing method that enables an even higher speed printing, a printed side after a fixing step does not become as smooth as compared to that of a contact thermally fusing method, so that the disadvantage of the abrasion resistance is found to be large.

A feature of the toner for electrostatic image development of the present invention is in that the toner contains:

a resin binder containing a polyester obtained from a carboxylic acid component monomer containing isophthalic acid and/or an ester thereof (hereinafter also referred to as isophthalic acid compound), and fumaric acid and/or an ester thereof (hereinafter also referred to as fumaric acid compound); and a charge control agent containing a negative chargeable charge control agent, which is a metal-containing azo dye and/or a metal complex of salicylic acid, and a positively chargeable charge control agent.

In other words, a polyester obtained from a carboxylic acid component containing a isophthalic acid compound and a fumaric acid compound not only serves to improve smearing property of the toner but also satisfy triboelectric stability and transferability of the toner after printing for a long period of time. As a result, an excellent image density can be maintained even after printing for a long period of time. Further, surprisingly, the toner of the present invention remarkably improves smearing property because the toner contains a positively chargeable charge control agent. Although not wanting to be limited by theory, the reasons why such a remarkable improvement is made are not clear, but are presumably as follows. An image density of a peripheral portion of an image becomes high because the toner contains a reversely charged positively chargeable charge control agent, so-called an edge effect, is suppressed, so that a printed layer becomes even. Consequently, the evenness leads to a reduced catchiness at the printed portion, thereby improving smearing property.

The resin binder in the present invention contains at least one kind of a polyester obtainable by polycondensing a carboxylic acid component and an alcohol component, wherein the carboxylic acid component contains isophthalic acid and/or an ester thereof, and fumaric acid and/or an ester thereof, provided that if two or more kinds of polyesters are used, the carboxylic acid component is taken as an overall component.

Therefore, in the resin binder, the isophthalic acid compound and the fumaric acid component may be used as a carboxylic acid component of different polyesters (a first embodiment), or may be used as a carboxylic acid component of the same polyester (a second embodiment). The first embodiment is preferred, from the viewpoint of improvements in triboelectric stability, transfer efficiency, image density, and smearing property of the toner after printing for a long period of time (hereinafter referred to durability printing).

In a first embodiment, the toner contains a resin binder containing:

a polyester A obtainable by polycondensing a carboxylic acid component containing isophthalic acid and/or an ester thereof and an alcohol component, and a polyester B obtainable by polycondensing a carboxylic acid component containing fumaric acid and/or an ester thereof and an alcohol component.

The isophthalic acid compound in the polyester A is contained in an amount of preferably 50% by mol or more, more preferably 70% by mol or more, and even more preferably 90% by mol or more, of the carboxylic acid component of the polyester A, from the viewpoint of improving transfer efficiency of the resulting toner after durability printing. Here, a terephthalic acid compound (terephthalic acid and/or an ester thereof) is contained in an amount of preferably 10% by mol or less, more preferably 5% by mol or less, and even more preferably 2% by mol or less, of the carboxylic acid component of the polyester A, from the viewpoint of preventing the lowering in transfer efficiency, and it is even more preferable that the terephthalic acid compound is not contained in the carboxylic acid component of the polyester A. In addition, it is preferable that the fumaric acid compound is not contained in the carboxylic acid component of the polyester A, from the viewpoint of increasing a reaction percentage of the isophthalic acid compound and improving transfer efficiency. If contained, the fumaric acid compound is contained in an amount of 5% by mol or less of the carboxylic acid component.

Here, the isophthalic acid compound refers to isophthalic acid, an acid anhydride thereof, and an alkyl(1 to 8 carbon atoms) ester thereof, among which isophthalic acid is preferred.

On the other hand, the fumaric acid compound in the polyester B is contained in an amount of preferably 50% by mol or more, more preferably 70% by mol or more, and even more preferably 90% by mol or more, of the carboxylic acid component of the polyester B, from the viewpoint of improving triboelectric stability of the toner after durability printing. Here, it is preferable that the isophthalic acid compound is not contained in the carboxylic acid component of the polyester B, from the viewpoint of triboelectric stability of the toner after durability printing. If contained, it is preferable that the isophthalic acid compound is contained in an amount of 5% by mol or less, of the carboxylic acid component of the polyester B.

Here, the fumaric acid compound refers to fumaric acid, an acid anhydride thereof, and an alkyl(1 to 8 carbon atoms) ester thereof, among which fumaric acid is preferred.

The polyester A and the polyester B in the resin binder in the first embodiment are in a weight ratio, i.e. polyester A/polyester B, of from 90/10 to 30/70, preferably from 80/20 to 40/60, and more preferably from 80/20 to 60/40, from the viewpoint of improving triboelectric stability, transfer efficiency and smearing property of the resulting toner after durability printing.

In a second embodiment of the present invention, the toner contains a resin binder containing a polyester C obtainable by polycondensing a carboxylic acid component containing an isophthalic acid compound and a fumaric acid compound and an alcohol component.

The isophthalic acid compound in the polyester C is contained in an amount of preferably 50% by mol or more, more preferably 60% by mol or more, and even more preferably 70% by mol or more, of the carboxylic acid component of the polyester C, from the viewpoint of improving transfer efficiency of the resulting toner after durability printing.

The fumaric acid compound in the polyester C is contained in an amount of preferably from 20 to 70 mol, more preferably from 30 to 60 mol, and even more preferably 40 to 50 mol, per 100 mol of the isophthalic acid compound, from the viewpoint of improving triboelectric stability of the toner after durability printing.

The polyester is obtainable by polycondensing an alcohol component and a carboxylic acid component, such as a carboxylic acid, a carboxylic acid anhydride, or a carboxylic acid ester as raw material monomers.

In addition, the carboxylic acid component other than the isophthalic acid compound and the fumaric acid compound usable in the polyester (which hereinafter means the polyester A, the polyester B, the polyester C, and other polyesters, unless specified otherwise) includes dicarboxylic acids such as phthalic acid, terephthalic acid, adipic acid, and succinic acid; succinic acids substituted with an alkyl group having 1 to 20 carbon atoms or an alkenyl group having 2 to 20 carbon atoms, such as dodecenylsuccinic acid, n-dodecylsuccinic acid, and octenylsuccinic acid; tricarboxylic or higher polycarboxylic acids such as trimellitic acid and pyromellitic acid; acid anhydrides thereof and alkyl(1 to 8 carbon atoms) esters of these acids; and the like.

The alcohol component of the polyester includes diols, such as diols having 2 to 20 carbon atoms, and more preferably 2 to 15 carbon atoms, and an alkylene oxide adduct of bisphenol A represented by the formula (I):

(I)

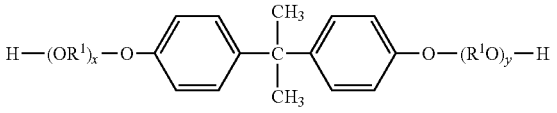

wherein each of $R^1O$ and $OR^1$ is an oxyalkylene group, wherein $R^1$ is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4; and trihydric or higher polyhydric alcohols having 3 to 20 carbon atoms, and preferably 3 to 10 carbon atoms; and the like.

Specific examples of the diol having 2 to 20 carbon atoms include ethylene glycol, propylene glycol, 1,6-hexanediol, bisphenol A, hydrogenated bisphenol A, and the like.

Specific examples of the trihydric or higher polyhydric alcohols having 3 to 20 carbon atoms include sorbitol, 1,4-sorbitan, pentaerythritol, glycerol, trimethylolpropane, and the like.

Among them, the alkylene oxide adduct of bisphenol A represented by the formula (I) is preferred, from the viewpoint of triboelectric stability of the toner after durability printing.

The alkylene oxide adduct of bisphenol A represented by the formula (I) is contained in an amount of preferably 5% by mol or more, more preferably 50% by mol or more, and even more preferably substantially 100% by mol, of the alcohol component, from the viewpoint of triboelectric stability of the toner after durability printing.

In addition, the alcohol component may properly contain a monohydric alcohol, and the carboxylic acid component may properly contain a monocarboxylic acid compound, from the viewpoint of adjusting its molecular weight, and the like.

In the present invention, it is preferable that all of the polyesters A to C are linear polyesters, from the viewpoint of low-temperature fixing ability. In the present invention, the linear polyester refers to a polyester containing a trivalent or higher polyvalent monomer, i.e. a trihydric or polyhydric alcohol and/or a tricarboxylic or higher polycarboxylic acid compound, in an amount of less than 1% by mol of a total amount of the carboxylic acid component and the alcohol component, and it is preferred that the trivalent or higher polyvalent monomer is not substantially contained. On the other hand, a nonlinear polyester refers to a polyester containing a trivalent or higher polyvalent monomer in an amount of 1% by mol or more of a total amount of the carboxylic acid component and the alcohol component. It is preferable that the resin binder of the toner of the present invention does not contain a nonlinear polyester, from the viewpoint of improving low-temperature fixing ability of the toner.

The polyester can be produced by, for example, polycondensing an alcohol component and a carboxylic acid component in an inert gas atmosphere at a temperature of 180° to 250° C., in the presence of an esterification catalyst, a polymerization inhibitor, or the like, as occasion demands. The esterification catalyst includes tin compounds such as dibutyltin oxide and tin(II) 2-ethylhexanoate, titanium compounds such as titanium diisopropylate bis(triethanolaminate), and the like. The esterification catalyst is used in an amount of preferably from 0.01 to 1 part by weight, and more preferably from 0.1 to 1 part by weight, based on 100 parts by weight of a total amount of the alcohol component.

Each of the polyesters A to C has a softening point of 90° C. or more, preferably 95° C. or more, and more preferably 100° C. or more, from the viewpoint of improving transfer efficiency of the toner during durability printing. In addition, each of the polyesters A to C has a softening point of 120° C. or less, preferably 115° C. or less, and more preferably 110° C., from the viewpoint of improving low-temperature fixing ability of the toner. In other words, from these viewpoints taken together, each of the polyesters A to C has a softening point of from 90° to 120° C., preferably from 95° to 115° C., and more preferably from 100° to 110° C. It is preferable that the resin binder as a whole also has a softening point within the above range.

Each of the polyesters A to C has a glass transition temperature of preferably 50° C. or more, and more preferably 55° C. or more, from the viewpoint of improving transfer efficiency of the toner during durability printing. In addition, each of the polyesters A to C has a glass transition temperature of preferably 85° C. or less, and more preferably 80° C. or less, from the viewpoint of improving low-temperature fixing ability of the toner. In other words, from these viewpoints taken together, each of the polyesters A to C has a glass transition temperature of preferably from 50° to 85° C., and more preferably from 55° to 80° C.

In both the softening point and the glass transition temperature, in a case where the polyester contains plural polyesters as in the first embodiment mentioned above, it is preferable that a weighted average thereof is within the above-mentioned range.

The polyester A has an acid value of preferably less than 6 mg KOH/g, and more preferably less than 4 mg KOH/g, from the viewpoint of controlling the amount of a low-molecular component and improving transferability.

The polyester other than the polyester A has an acid value of preferably 50 mg KOH/g or less, more preferably 30 mg KOH/g or less, and even more preferably 20 mg KOH/g or less, from the same viewpoint.

Here, in the present invention, the polyester may be a modified polyester to an extent that its properties are not substantially impaired. The modified polyester refers to a grafted or blocked polyester with phenol, urethane, epoxy, or the like, in accordance with the methods described in, for example, JP-A-Hei-11-133668, JP-A-Hei-10-239903, JP-A-Hei-8-20636, and the like.

The polyesters A and B are contained in a total amount of, or the polyester C is contained in an amount of, preferably from 70 to 100% by weight, and more preferably substantially 100% by weight, of the resin binder, from the viewpoint of triboelectric stability, transfer efficiency, image density, and smearing property of the toner after durability printing.

In the present invention, a resin binder may properly contain a polyester other than the above-mentioned polyesters A to C, in other words, a polyester in which the isophthalic acid compound or the fumaric acid compound is not used as a carboxylic acid component, and other resin binders to an extent that would not impair the effects of the present invention. Other resin binders include vinyl resins, epoxy resins, polycarbonates, polyurethanes, and the like.

The toner of the present invention contains, as charge control agents, a specified negatively chargeable charge control agent and a positively chargeable charge control agent. By combining the negatively chargeable charge control agent and the positively chargeable charge control agent together, the resulting toner has improved triboelectric stability after durability printing. Also, since the positively chargeable charge control agent is contained, the resulting toner has improved smearing property.

The toner of the present invention contains a metal-containing azo dye and or a metal complex of an alkyl derivative of salicylic acid as the negatively chargeable charge control agent, from the viewpoint of improving triboelectric stability of the toner after durability printing.

The metal-containing azo dye includes an azo-iron complex, an azo-chromium complex, an azo-cobalt complex, and the like. In the present invention, the azo-iron complex is preferred, from the viewpoint of triboelectric stability.

The azo-iron complex includes, for example, a compound represented by the formula (II):

(II)

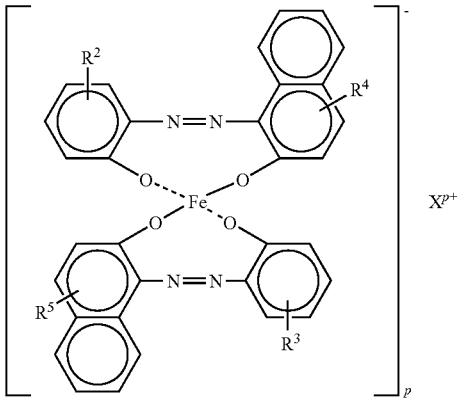

wherein each of $R^2$ and $R^3$ is independently a halogen atom or a nitro group; each of $R^4$ and $R^5$ is independently a hydrogen atom, a halogen atom, an alkyl group having 1 to 3 carbon atoms, or a —CO—NH—($C_6H_5$) group; $X^{p+}$ is a cation; and p is an integer of 1 or 2.

In the present invention, among the azo-iron complexes represented by the formula (II), a metal complex compound where each of $R^2$ and $R^3$ is a halogen atom, and even more preferably a chlorine atom, and each of $R^4$ and $R^5$ is a —CO—

NH—($C_6H_5$) group, and $X^{p+}$ is a hydrogen ion, a sodium ion, or an ammonium ion is preferable.

Here, regarding the azo-iron complex represented by the formula (II), a detailed production method therefor is described, for example, in JP-A-Sho-61-155464 or the like, and the azo-iron complex can be easily synthesized in accordance with the method. Commercially available products include, for example, "T-77" (commercially available from Hodogaya Chemical Co., Ltd.).

The metal complex of an alkyl derivative of salicylic acid includes, for example, a compound represented by the formula (III):

(III)

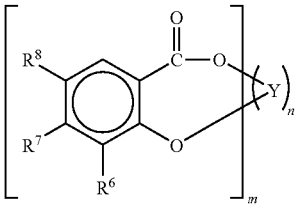

wherein each of $R^6$, $R^7$, and $R^8$ is independently a hydrogen atom, a linear or branched, alkyl group having 1 to 10 carbon atoms or alkenyl group having 2 to 10 carbon atoms; Y is chromium, zinc, calcium, zirconium or aluminum; m is an integer of 2 or more; and n is an integer of 1 or more.

In the formula (III), $R^7$ is preferably a hydrogen atom, and each of $R^6$ and $R^8$ is preferably a branched alkyl group, and more preferably a tert-butyl group.

Commercially available products of the compounds represented by the formula (III) include "BONTRON E-81" (where $R^7$: a hydrogen atom, $R^6$ and $R^8$: a tert-butyl group, and Y: chromium, commercially available from Orient Chemical Co., Ltd.), "BONTRON E-84" (where $R^7$: a hydrogen atom, $R^6$ and $R^8$: a tert-butyl group, and Y: zinc, commercially available from Orient Chemical Co., Ltd.), "BONTRON E-88" (where $R^7$: a hydrogen atom, $R^6$ and $R^8$: a tert-butyl group, and Y: aluminum, commercially available from Orient Chemical Co., Ltd.), "BONTRON E-304" (where $R^7$: a hydrogen atom, $R^6$ and $R^8$: a tert-butyl group, and Y: zinc, commercially available from Orient Chemical Co., Ltd.), "TN-105" (where $R^7$: a hydrogen atom, $R^6$ and $R^8$: a tert-butyl group, and Y: zirconium, commercially available from Hodogaya Chemical Co., Ltd.), and the like.

In a black toner, a metal-containing azo dye and a metal complex of an alkyl derivative of salicylic acid are used, and an iron complex "T-77" is more preferable, from the viewpoint of safety. In color toners, a metal complex of an alkyl derivative of salicylic acid is preferably used, especially from the viewpoint of hue, or a zinc complex "BONTRON E-84" is more preferably used from the viewpoint of triboelectric stability of the toner after durability printing.

The negatively chargeable charge control agent is contained in an amount of preferably 0.5 parts by weight or more, and more preferably 1 part by weight or more, based on 100 parts by weight of the resin binder, from the viewpoint of improving a triboactivation of the toner. In addition, the negatively chargeable charge control agent is contained in an amount preferably of 5 parts by weight or less, and more preferably 4 parts by weight or less, based on 100 parts by weight of the resin binder, from the viewpoint of improving triboelectric stability of the toner after durability printing. In other words, from these viewpoints taken together, the negatively chargeable charge control agent is contained in an amount of preferably from 0.5 to 5 parts by weight, and more preferably from 1 to 4 parts by weight, based on 100 parts by weight of the resin binder.

The positively chargeable charge control agent includes Nigrosine dyes, for example, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.), and the like; triphenylmethane-based dyes containing a tertiary amine as a side chain; quaternary ammonium salt compounds, for example, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PSY," "COPY CHARGE PX VP 435" (commercially available from Clariant GmbH), and the like; polyamine resins, for example, "AFP-B" (commercially available from Orient Chemical Co., Ltd.), and the like; and imidazole derivatives, for example, "PLZ-2001," "PLZ-8001" (hereinabove commercially available from Shikoku Kasei K.K.), and the like.

As the positively chargeable charge control agent, the quaternary ammonium salt compounds, such as "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PSY," and "COPY CHARGE PX VP435" (commercially available from Clariant GmbH) are preferable, from the viewpoint of triboelectric stability and smearing property of the toner after durability printing. Among them, quaternary ammonium salt compounds having a carboxylate group as a counterion are preferred, from the viewpoint of improving dispersibility of the compounds into the resin.

The quaternary ammonium salt compound having a carboxylate group as a counterion includes, for example, a compound represented by the formula (IV):

(IV)

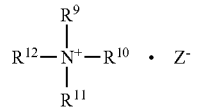

wherein each of $R^9$ to $R^{12}$, which may be identical or different, is a lower alkyl group having 1 to 8 carbon atoms, which is unsubstituted or substituted with a halogen atom, an alkyl group or alkenyl group having 8 to 22 carbon atoms, an aryl group having 6 to 20 carbon atoms, or an aralkyl group having 7 to 20 carbon atoms; and Z" is a carboxylate ion.

In the present invention, each of $R^9$ to $R^{12}$ is preferably a lower alkyl group having 1 to 4 carbon atoms, which is unsubstituted or substituted with a halogen atom, an alkyl group having 12 to 18 carbon atoms, a phenyl group, or a benzyl group, from the viewpoint of even more stabilizing triboelectric properties, thereby making it possible to improve fixing ability. $Z^-$ is preferably an aromatic carboxylate ion or an aliphatic carboxylate ion, and more preferably an aromatic carboxylate ion from the same viewpoint. The aromatic carboxylate ion includes ions of carboxylic acids having a structure of benzoic acid, such as benzoic acid or dithiodibenzoic acid.

The above-mentioned quaternary ammonium salt compounds include a compound represented by the formula (IVa):

(IVa)

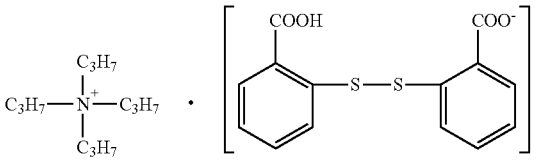

Among the quaternary ammonium compounds mentioned above, specific examples include "COPY CHARGE PSY" (commercially available from Clariant GmbH) that contains the above compound.

The positively chargeable charge control agent is contained in an amount of preferably 0.1 parts by weight or more, and more preferably 0.2 parts by weight or more, based on 100 parts by weight of the resin binder, from the viewpoint of improving triboelectric stability of the toner after durability printing and from the viewpoint of improving smearing property. In addition, the positively chargeable charge control agent is contained in an amount of preferably 3 parts by weight or less, and more preferably 2 parts by weight or less, based on 100 parts by weight of the resin binder, from the viewpoint of improving smearing property. In other words, from these viewpoints taken together, the positively chargeable charge control agent is contained in an amount of preferably from 0.1 to 3 parts by weight, and more preferably from 0.2 to 2 parts by weight, based on 100 parts by weight of the resin binder.

The positively chargeable charge control agent and the negatively chargeable charge control agent are in a weight ratio, i.e. positively chargeable charge control agent/negatively chargeable charge control agent, of preferably from 1/20 to 1/2, more preferably from 1/10 to 1/2, and even more preferably from 1/5 to 1/2, from the viewpoint of triboelectric stability and smearing property.

It is preferable that the toner of the present invention contains a colorant and a releasing agent.

As the colorant, all of dyes, pigments, and the like which are used as colorants for a toner can be used.

The yellow colorant includes compounds represented by condensed azo compounds, isoindolenone compounds, anthraquinone compounds, azo-metal complex methine compounds, and allylamide compounds. Specific examples of the yellow colorant include C. I. Pigment Yellow 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 166, 168 to 177, 179, 180, 181, 183, 185, 191:1, 191, 192, 193, 199, and the like.

The magenta colorant includes condensed azo compounds, diketopyrrolopyrrole compounds, anthaquinones, quinacridone compounds, basic dye lake compounds, naphthol compounds, benzimidazolone compounds, thioindigo compounds, perylene compounds, and the like. Specific examples of the magenta colorant include C. I. Pigment Red 2, 3, 5 to 7, 23, 48:2, 48:3, 48:4, 57:1, 81:1, 122, 146, 166, 169, 177, 184, 185, 202, 206, 220, 221, and 254; C. I. Pigment Violet 19; and the like.

The cyan colorant includes copper phthalocyanine compounds and derivatives thereof, anthraquinone compounds, basic dye lake compounds, and the like. Specific examples of the cyan colorant include C. I. Pigment Blue 1, 7, 15, 15:1, 15:2, 15:3, 15:4, 60, 62, 66; and the like.

The colorant for a black toner includes carbon blacks, aniline blacks, magnetite, Ti/Fe-based composite oxides, and the like.

The colorant is contained in an amount of preferably from 1 to 40 parts by weight, and more preferably from 2 to 10 parts by weight, based on 100 parts by weight of the resin binder.

The releasing agent includes aliphatic hydrocarbon waxes, such as low-molecular weight polypropylenes, low-molecular weight polyethylenes, low-molecular weight polypropylene-polyethylene copolymers, microcrystalline waxes, paraffin waxes, and Fischer-Tropsch wax, and oxides thereof; ester waxes, such as carnauba wax, montan wax, and sazole wax, and deacid waxes thereof, and fatty acid ester waxes; fatty acid amides, fatty acids, higher alcohols, metal salts of fatty acids, and the like. Among them, the aliphatic hydrocarbon waxes and the ester waxes are preferable, the ester waxes are more preferable, and the carnauba wax is even more preferable, from the viewpoint of improving low-temperature fixing ability and smearing property of the toner. These releasing agents may be contained alone or in a mixture of two or more kinds.

The releasing agent has a melting point of preferably 100° C. or less, more preferably 95° C. or less, and even more preferably 90° C. or less, from the viewpoint of improving the low-temperature fixing ability of the toner and improving smearing property. The releasing agent has a melting point of preferably 60° C. or more, more preferably 70° C. or more, and even more preferably 80° C. or more, from the viewpoint of improving dispersibility of the colorant in the toner, thereby improving triboelectric stability. In other words, from these viewpoints taken together, the releasing agent has a melting point of preferably from 60° to 100° C., more preferably from 70° to 95° C., and even more preferably from 80° to 90° C.

The releasing agent is contained in an amount of preferably from 0.5 to 4.0 parts by weight, and more preferably from 1.0 to 3.0 parts by weight, based on 100 parts by weight of the resin binder, from the viewpoint of improving low-temperature fixing ability of the toner and from the viewpoint of improving smearing property.

The toner of the present invention may appropriately further contain an additive such as a magnetic powder, a fluidity improver, an electric conductivity modifier, an extender, a reinforcing filler such as a fibrous substance, an antioxidant, an anti-aging agent, or a cleanability improver.

The toner of the present invention may be a toner obtainable by any of known methods such as a kneading-pulverization method, an emulsion phase-inversion method, and a polymerization method, and a pulverized toner according to the kneading-pulverization method is preferred from the viewpoint of productivity and dispersibility of a colorant. Specifically, toner particles can be produced by homogeneously mixing raw materials such as a resin binder, a colorant, a charge control agent, and a releasing agent with a mixer such as a Henschel mixer, thereafter melt-kneading the mixture with a closed kneader, a single-screw or twin-screw extruder, open-roller type kneader, or the like, cooling, pulverizing, and classifying the product so as to give a desired volume-median particle size ($D_{50}$) and a particle size distribution. On the other hand, a toner according to a polymerization method is preferred from the viewpoint of forming a toner having a smaller particle size.

The toner particles have a volume-median particle size ($D_{50}$) of preferably from 3 to 15 μm, and more preferably from 4 to 8 μm, from the viewpoint of obtaining a stable development efficiency. The term "volume-median particle size ($D_{50}$)" as used herein means a particle size of which cumulative volume frequency calculated in the volume percentage accounts for 50% calculated from a smaller particle size.

The toner of the present invention may be those that are obtainable by a method further including the step, subsequent to pulverizing and classifying steps, of mixing with an external additive such as fine inorganic particles or fine resin particles made of polytetrafluoroethylene.

A mixer to be used upon mixing the toner particles and the external additive is preferably an agitator used in dry blending, such as a high-speed agitator such as a Henschel mixer or a Super Mixer, or a V-type blender. The external additive may be previously mixed and added in a high-speed agitator or a V-type blender, or the external additives may be separately added.

The toner has a softening point of 120° C. or less, preferably 115° C. or less, and more preferably 110° C. or less, from the viewpoint of improving low-temperature fixing ability of the toner. In addition, the toner has a softening point of 90° C. or more, preferably 95° C. or more, and more preferably from 100° C. or more, from the viewpoint of improving transfer efficiency of the toner during durability printing. In other words, from these viewpoints taken together, the toner has a softening point of from 90° to 120° C., preferably from 95° to 115° C., and more preferably from 100° to 110° C. A method of adjusting a softening point includes, for example, a method of adjusting a molar ratio of a carboxylic acid component to an alcohol component; and a method of modifying reactions conditions for esterification, such as a reaction temperature, an amount of a catalyst, or carrying out dehydration reaction under a reduced pressure for a long period of time. Specifically, a softening point can be elevated by approximating the ratio of the carboxylic acid component to the alcohol component to 1, or by elevating a reaction temperature, increasing an amount of a catalyst, or extending a reaction time for dehydration reaction. On the other hand, if these variables are changed conversely, the softening point is likely to be lowered.

The toner has a glass transition temperature of preferably 70° C. or less, and more preferably 65° C. or less, from the viewpoint of improving low-temperature fixing ability of the toner. In addition, the toner has a glass transition temperature of preferably 45° C. or more, and more preferably 50° C. or more, from the viewpoint of improving transfer efficiency of the toner during durability printing. In other words, from these viewpoints taken together, the toner has a glass transition temperature of preferably from 45° to 70° C., and more preferably from 50° to 65° C.

The toner of the present invention can exhibit excellent smearing property, when the toner is used in an apparatus for forming fixed images according to a non-contact fusing method, such as oven fusing or flash fusing. The toner can be suitably used also in an apparatus for forming fixed image using a high speed having a linear speed of from 800 mm/sec or more, and preferably from 1,000 to 3,000 mm/sec. Here, the term "linear speed" refers to a processing speed for an apparatus for forming fixed images, which is determined by a paper-feeding speed at a fixing member.

In addition, a method for development of the toner of the present invention is not particularly limited, and the toner can be suitably used also in the method for forming fixed images using an apparatus for forming fixed images according to a non-contact development method, because the toner has excellent triboelectric stability, transfer efficiency, and image density after durability printing, and the toner can also be suitably used in an apparatus for forming fixed image according to a non-contact development method having a high linear speed of from 800 mm/sec or more, and preferably from 1,000 to 3,000 mm/sec.

The toner of the present invention can be used directly as a toner for monocomponent development, or mixed with a carrier to prepare a two-component developer. The toner of the present invention can be suitably used in an apparatus for forming fixed images according to a nonmagnetic development method, especially a nonmagnetic two-component development method, from the viewpoint of obtaining especially stable triboelectric chargeability under agitating conditions with a carrier.

Therefore, the toner of the present invention can also be suitably used in a method for forming fixed images using a high-speed apparatus for forming fixed images according to a nonmagnetic two-component development method and a non-contact development method.

In the present invention, as the carrier, a carrier having a low saturated magnetization which has a weaker contact with a magnetic brush is preferable, from the viewpoint of the image properties. The carrier has a saturated magnetization of preferably from 40 to 100 $Am^2/kg$, and more preferably from 50 to 90 $Am^2/kg$. The carrier has a saturated magnetization of preferably 100 $Am^2/kg$ or less, from the viewpoint of controlling the hardness of the magnetic brush and retaining the tone reproducibility, and the carrier has a saturated magnetization of preferably 40 $Am^2/kg$ or more, from the viewpoint of preventing the carrier from being adhered and toner dust.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, from the viewpoint of triboelectric chargeability.

The surface of the carrier can be coated with a resin, from the viewpoint of preventing the formation of toner scumming on the carrier. The resin for coating the surface of the carrier may vary depending upon the toner materials, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. These resins can be used alone or in a combination of two or more kinds. The method of coating a core material with a resin is not particularly limited, and includes, for example, a method of dissolving or suspending a coating material such as a resin in a solvent, and applying the solution or suspension to be deposited on a core material, a method of simply blending in the state of powder, and the like.

In a two-component developer obtained by mixing the toner with a carrier, the toner is contained in an amount of preferably from 0.5 to 10 parts by weight, and more preferably from 2 to 8 parts by weight, based on 100 parts by weight of the carrier, from the viewpoint of fluidity of the developer, and reduction of background fogging and generation of dust.

EXAMPLES

The following examples further describe and demonstrate embodiments of the present invention. The examples are given solely for the purposes of illustration and are not to be construed as limitations of the present invention.

[Softening Points (Tm) of Resins and Toners]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a sample is prepared by applying a load of 1.96 MPa thereto with the plunger and extruding a 1 g sample through a nozzle having a die pore size of 1 mm and a length of 1 mm, while heating the sample so as to raise the temperature at a rate of 6° C./min.

[Glass Transition Temperatures (Tg) of Resins and Toners]

The glass transition temperature refers to a temperature of an intersection of the extension of the baseline of equal to or lower than the temperature of the maximum endothermic peak and the tangential line showing the maximum inclination between the onset of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Values of Resins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio)).

[Melting Point of Releasing Agents]

A temperature of maximum endothermic peak of the heat of fusion obtained by raising the temperature of a sample to 200° C. using a differential scanning calorimeter ("DSC 210," commercially available from Seiko Instruments, Inc.), cooling the sample from this temperature to 0° C. at a cooling rate of 10° C./min, and thereafter raising the temperature of the sample at a heating rate of 10° C./min, is referred to as a melting point.

[Volume-Median Particle Size ($D_{50}$) of Toner Particles]

Measuring Apparatus Coulter Multisizer II (commercially available from Beckman Coulter, Inc.)

Aperture Diameter: 50 μm

Analyzing Software: Coulter Multisizer AccuComp Ver. 1.19 (commercially available from Beckman Coulter, Inc.)

Electrolytic Solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions Ten milligrams of a measurement sample is added to 5 ml of the above dispersion, and the mixture is dispersed for 1 minute with an ultrasonic disperser, and 25 ml of an electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 toner particles can be measured in 20 seconds, and thereafter the 30,000 particles are measured, and a volume-median particle size ($D_{50}$) is obtained from the particle size distribution.

[Saturated Magnetization of Carriers]

(1) A carrier is filled in a plastic case with a lid with tapping, the case having an outer diameter of 7 mm (inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturated magnetization is determined by applying a magnetic field of 79.6 kA/m, while vibrating the plastic case using the vibration function. The value obtained is calculated as the saturated magnetization per unit mass, taking into consideration the mass of the filled carrier.

Production Example 1 for Resin

A 5-liter four-neck flask equipped with a nitrogen inlet tube, a dehydration tube, a stirrer, and a thermocouple were charged with an alcohol component and a carboxylic acid component listed in Table 1 and 19.5 g of dibutyltin oxide, and the components were allowed to react at 230° C. under nitrogen atmosphere until a reaction percentage reached 90%. Thereafter, the reaction mixture was allowed to react at 8.3 kPa until a softening point reached 109° C., to provide a polyester (Resin A). Here, the reaction percentage as used in the present invention is a value obtained by the formula of [amount of reaction water (mol)/theoretical amount of generated water (mol)]×100.

Production Example 2 for Resin

A 5-liter four-neck flask equipped with a nitrogen inlet tube, a dehydration tube, a stirrer, and a thermocouple were charged with an alcohol component and a carboxylic acid component listed in Table 1, 19.5 g of dibutyltin oxide, and 2 g of a polymerization inhibitor hydroquinone, and the components were allowed to react at 230° C. under nitrogen atmosphere until a reaction percentage reached 90%. Thereafter, the reaction mixture was allowed to react at 8.3 kPa until a softening point reached 100° C., to provide a polyester (Resin B).

Production Example 3 for Resin

A 5-liter four-neck flask equipped with a nitrogen inlet tube, a dehydration tube, a stirrer, and a thermocouple were charged with an alcohol component and a carboxylic acid component other than fumaric acid listed in Table 1 and 19.5 g of dibutyltin oxide, and the components were allowed to react at 230° C. for 5 hours under nitrogen atmosphere and then at 8.3 kPa for 1 hour. The reaction mixture was cooled to 210° C., fumaric acid and 2 g of hydroquinone were added to the reaction mixture, and the components were allowed to react for 5 hours, and thereafter further at 8.3 kPa until a softening point reached 111° C., to provide a polyester (Resin C).

Production Example 4 for Resin

The same procedures as in Production Example 1 for Resin were carried out except that terephthalic acid was used in place of isophthalic acid, and that the components were allowed to react until a softening point of 111° C. was reached, to provide a polyester (Resin D).

Production Example 5 for Resin

A 5-liter four-neck flask equipped with a nitrogen inlet tube, a dehydration tube, a stirrer, and a thermocouple were charged with an alcohol component and a carboxylic acid component other than adipic acid listed in Table 1 and 19.5 g of dibutyltin oxide, and the components were allowed to react at 230° C. for 5 hours under nitrogen atmosphere and then at 8.3 kPa for 1 hour. The reaction mixture was cooled to 210° C., adipic acid was added to the reaction mixture, the mixture was heated to 220° C., and the components were allowed to react for 3 hours, and thereafter further at 8.3 kPa until a softening point reached 107° C., to provide a polyester (Resin E).

TABLE 1

| | Resin A | Resin B | Resin C | Resin D | Resin E |
|---|---|---|---|---|---|
| Alcohol Component | | | | | |
| BPA-PO[1)] | 980 g(35) | 2688 g(100) | 980 g(35) | 980 g(35) | — |
| BPA-EO[2)] | 1690 g(65) | — | 1690 g(65) | 1690 g(65) | 2600 g(100) |
| Carboxylic Acid Component | | | | | |
| Fumaric Acid | — | 929 g(104) | 279 g(30) | — | — |
| Isophthalic Acid | 1223 g(92) | — | 930 g(70) | — | 1063 g(80) |
| Terephthalic Acid | — | — | — | 1223 g(92) | — |
| Adipic Acid | — | — | — | — | 234 g(20) |
| Softening Point (° C.) | 109.1 | 100.1 | 111.5 | 111.2 | 107.1 |
| Glass Transition Temp. (° C.) | 63.2 | 60.5 | 60.4 | 65.5 | 53.1 |
| Acid Value (mgKOH/g) | 3.5 | 19.2 | 8.5 | 4.8 | 10.1 |

Note)
The numerical values inside the parenthesis are expressed by a molar ratio, supposing that a total number of moles of the alcohol component is 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane

Examples 1 to 8 and Comparative Examples 1 to 7

A resin binder, a colorant, a positively chargeable charge control agent and a negatively chargeable charge control agent, each listed in Table 2, and 2 parts by weight of a releasing agent "Carnauba Wax No. 1" (commercially available from S. Kato & CO., melting point 81° C.) were mixed with a Henschel mixer for 60 seconds, while stirring. The resulting mixture was melt-kneaded with a twin-screw extruder, and the melt-kneaded mixture was cooled and then roughly pulverized with a hammer mill to a size of 1 mm or so. The resulting roughly pulverized product was finely pulverized with an air-jet pulverizer, and the finely pulverized product was classified, to provide negatively chargeable toner particles having a volume-median particle size ($D_{50}$) of 7.2 μm.

One-hundred parts by weight of the resulting toner particles, 0.9 parts by weight of a hydrophobic silica "R-972" (commercially available from Nippon Aerosil Co., Ltd.) and 1.0 part by weight of a hydrophobic silica "NAX-50" (commercially available from Nippon Aerosil Co., Ltd.) were mixed with a Henschel mixer at 1500 r/min for 3 minutes, to provide a toner. Here, in Comparative Example 7, the deposition of a roughly pulverized product took place in a pulverizer upon pulverizing the roughly pulverized product, so that the toner could not be formed.

TABLE 2

| | Colorant (Parts by Weight) | Resin Binder (Parts by Weight) | Positively Chargeable Charge Control Agent (Parts by Weight) | Negatively Chargeable Charge Control Agent (Parts by Weight) | Softening Point of Toner (° C.) | Glass Transition Temp. of Toner (° C.) |
|---|---|---|---|---|---|---|
| Ex. 1 | Carbon Black (6) | Resin A (70) Resin B (30) | Quaternary Ammonium Salt A (0.4) | Azo-Iron Complex (1) | 106.8 | 58.4 |
| Ex. 2 | Carbon Black (6) | Resin A (70) Resin B (30) | Quaternary Ammonium Salt B (0.4) | Azo-Iron Complex (1) | 106.2 | 58.1 |
| Ex. 3 | Carbon Black (6) | Resin A (70) Resin B (30) | Quaternary Ammonium Salt A (0.4) | Azo-Chromium Complex (1) | 107.1 | 59.1 |
| Ex. 4 | Cyan Pigment (3) | Resin A (70) Resin B (30) | Quaternary Ammonium Salt A (0.4) | Zinc Complex of Salicylic Acid (2) | 109.5 | 57.5 |
| Ex. 5 | Carbon Black (6) | Resin A (30) Resin B (70) | Quaternary Ammonium Salt A (0.4) | Azo-Iron Complex (1) | 103.8 | 54.1 |
| Ex. 6 | Carbon Black (6) | Resin A (70) Resin B (30) | Quaternary Ammonium Salt A (0.2) | Azo-Iron Complex (2) | 105.4 | 58.4 |
| Ex. 7 | Carbon Black (6) | Resin A (90) Resin B (10) | Quaternary Ammonium Salt A (0.4) | Azo-Iron Complex (1) | 108.8 | 59.8 |
| Ex. 8 | Carbon Black (6) | Resin C (100) | Quaternary Ammonium Salt A (0.4) | Azo-Iron Complex (1) | 109.8 | 57.8 |
| Comp. Ex. 1 | Carbon Black (6) | Resin A (70) Resin B (30) | — | Azo-Iron Complex (1) | 106.2 | 58.0 |
| Comp. Ex. 2 | Carbon Black (6) | Resin A (70) Resin B (30) | Quaternary Ammonium Salt A (0.4) | Boron Complex of Benzylic Acid (0.5) | 106.4 | 58.2 |
| Comp. Ex. 3 | Cyan Pigment (3) | Resin A (70) Resin B (30) | — | Zinc Complex of Salicylic Acid (2) | 109.4 | 57.1 |

TABLE 2-continued

| | Colorant (Parts by Weight) | Resin Binder (Parts by Weight) | Positively Chargeable Charge Control Agent (Parts by Weight) | Negatively Chargeable Charge Control Agent (Parts by Weight) | Softening Point of Toner (° C.) | Glass Transition Temp. of Toner (° C.) |
|---|---|---|---|---|---|---|
| Comp. Ex. 4 | Carbon Black (6) | Resin A (100) | Quaternary Ammonium Salt A (0.4) | Azo-Iron Complex (1) | 110.9 | 60.2 |
| Comp. Ex. 5 | Carbon Black (6) | Resin B (100) | Quaternary Ammonium Salt A (0.4) | Azo-Iron Complex (1) | 99.8 | 52.1 |
| Comp. Ex. 6 | Carbon Black (6) | Resin B (30) Resin D (70) | Quaternary Ammonium Salt A (0.4) | Azo-Iron Complex (1) | 107.1 | 59.5 |
| Comp. Ex. 7 | Carbon Black (6) | Resin E (100) | Quaternary Ammonium Salt A (0.4) | Azo-Iron Complex (1) | Not being able to form into a toner | |

Note)
The manufacturer inside the parenthesis means one commercially available from.
Carbon Black: "NIPEX60" (Degussa Japan Co., Ltd.)
Cyan Pigment: "ECB301" (DAINICHISEIKA COLOR & CHEMICALS MFG. CO., LTD., copper phthalocyanate)
Quaternary Ammonium Salt A: "COPY CHARGE PSY"(Clariant GmbH)
Quaternary Ammonium Salt B: "BONTRON P-51"(Orient Chemical Co., Ltd.)
Azo-Iron Complex: "T-77" (Hodogaya Chemical Co., Ltd.)
Azo-Chromium Complex: "BONTRON S-34" (Orient Chemical Co., Ltd.)
Zinc Complex of Salicylic Acid: "BONTRON E-84" (Orient Chemical Co., Ltd.)
Boron Complex of Benzylic Acid: "LR147" (Japan Carlit, Ltd.)

Test Example 1

Triboelectric Stability

Six parts by weight of a toner obtained and 94 parts by weight of a ferrite carrier ("KK01-C35" (commercially available from Océ Printing Systems GmbH, volume-average particle size: 60 μm, saturated magnetization: 68 $Am^2/kg$) were mixed together, to provide a two-component developer. The resulting two-component developer was loaded on an apparatus for forming fixed images according to a non-contact development method and a non-contact fusing method "Vario stream 9000" (commercially available from Oce Printing Systems GmbH), and durability printing was conducted at a print coverage of 9% at a linear speed of 1000 mm/sec for 3 hours. Thereafter, the developer was taken out of the developer station, and the triboelectric charges were measured with a q/m meter (500 mesh being used) commercially available from Epping GmbH. Further, durability printing was conducted at a print coverage of 0.15% for 3 hours, and the triboelectric charges were measured in the same manner. Triboelectric stability was evaluated on the basis of a difference in triboelectric charges. It can be said that the smaller the difference in triboelectric charges, the more stable the triboelectric stability. The results are shown in Table 3.

Test Example 2

Transferability

A two-component developer obtained in the same manner as in Test Example 1 was loaded on an apparatus for forming fixed images according to a non-contact development method and a non-contact fusing method "Vario stream 9000" (commercially available from Océ Printing Systems GmbH), and a durability printing test was conducted at a print coverage of 9%, a linear speed of 1,000 mm/sec for 3 hours. Thereafter, a durability printing test was conducted at a print coverage of 0.15% for 3 hours, the printer was hard-stopped, and the amount of the toner on a photoconductor (To) and the amount of the toner on paper (Tp) were weighed. Defining a value calculated by the formula of Tp/To×100 as the transfer efficiency, the transferability was evaluated in accordance with the following evaluation criteria. The higher the transfer efficiency, the more excellent the transferability. The results are shown in Table 3.

[Evaluation Criteria]
A: Transfer efficiency is 80% or more.
B: Transfer efficiency is 70% or more and less than 80%.
C: Transfer efficiency is 60% or more and less than 70%.
D: Transfer efficiency is less than 60%.

Test Example 3

Image Density of Half Tone

Image samples obtained immediately before the hard stop in Test Example 2 were collected, and the image densities were measured with a colorimeter "GretagMacbeth Spectroeye" (commercially available from GretagMacbeth CO.) at 5 points of the printed portion of the fixed images, and an average was calculated as an image density (ID) to evaluate image densities. Here, the image density measurements were taken under the mode where a polarized plate was not inserted. The results are shown in Table 3.

Test Example 4

Smearing Property

A two-component developer obtained in the same manner as in Test Example 1 was loaded on an apparatus for forming fixed images according to a non-contact development method and a non-contact fusing method "Vario stream 9000" (commercially available from Oce Printing Systems GmbH), and printing was conducted at a print coverage of 9%, and a linear speed of 1,000 mm/sec to provide printouts. A 500 g stainless weight having a length of 3 cm, a width of 3 cm, and a height of 6.5 cm was placed on the printouts obtained, and the weight was reciprocated over the printed portion of the fixed images having a length of 30 cm and a width of 3 cm at a speed of 0.5 m/s. Supposing that one reciprocation was counted as once, the smearing property was evaluated in accordance with the following evaluation criteria on the basis of the number of times at which a toner adhesion in a black banded state initially appeared in non-printing portions. The larger the number of times, the more excellent the smearing property. The results are shown in Table 3.

[Evaluation Criteria]
A: The number of times is 50 or more.
B: The number of times is 40 or more and less than 50.

C: The number of times is 30 or more and less than 40.
D: The number of times is less than 30.

TABLE 3

| | Triboelectric Charges* After Durability Printing (μC/g) | Transferability After Durability Printing (Transfer Efficiency) | Image Density ID of Half Tone (Print Coverage 0.15%) | Smearing Property of Printouts |
|---|---|---|---|---|
| Ex. 1 | 4 | A | 1.3 | A |
| Ex. 2 | 5 | A | 1.2 | A |
| Ex. 3 | 6 | A | 1.0 | A |
| Ex. 4 | 4 | A | 0.9 | A |
| Ex. 5 | 2 | A | 1.3 | B |
| Ex. 6 | 3 | A | 1.2 | A |
| Ex. 7 | 8 | A | 1.3 | A |
| Ex. 8 | 7 | A | 1.0 | B |
| Comp. Ex. 1 | 12 | A | 0.6 | D |
| Comp. Ex. 2 | 13 | B | 0.6 | A |
| Comp. Ex. 3 | 10 | A | 0.6 | D |
| Comp. Ex. 4 | 11 | A | 0.7 | A |
| Comp. Ex. 5 | 4 | C | 0.5 | C |
| Comp. Ex. 6 | 10 | D | 0.3 | C |

*Difference in triboelectric charges at a print coverage of 9% and that of 0.15%

It can be seen from the above results that the toners of Examples 1 to 8 have excellent triboelectric stability, transfer efficiency and image density after durability printing, and further have excellent smearing property, as compared to those of the toners of Comparative Examples 1 to 7.

The toner for electrostatic image development of the present invention can be suitably used in developing latent images formed in, for example, electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising:
a resin binder,
a negatively chargeable charge control agent, and
a positively chargeable charge control agent,
wherein the resin binder comprises
a polyester A obtained by polycondensing a carboxylic acid component comprising isophthalic acid and/or an ester thereof and an alcohol component, and
a polyester B obtained by polycondensing a carboxylic acid component comprising fumaric acid and/or an ester thereof and an alcohol component,
wherein the polyester A and the polyester B are in a weight ratio, polyester A/polyester B, of from 90/10 to 30/70, and
wherein the negatively chargeable charge control agent comprises a metal-containing azo dye and/or a metal complex of salicylic acid, and wherein the toner has a softening point of from 90° to 120° C.

2. A method for forming fixed images comprising the step of applying the toner as defined in claim 1 to an apparatus for forming fixed images according to a non-contact fusing method.

3. The toner according to claim 1, wherein the carboxylic acid component of polyester A comprises 50% by mol or more of isophthalic acid and/or an ester thereof, and 10% by mol or less including 0%, of terephthalic acid and/or an ester thereof.

4. The toner according to claim 1, wherein the carboxylic acid component of polyester A comprises 70% by mol or more of isophthalic acid and/or an ester thereof, and 5% by mol or less including 0%, of terephthalic acid and/or an ester thereof.

5. The toner according to claim 1, wherein the carboxylic acid component of polyester A comprises 90% by mol or more of isophthalic acid and/or an ester thereof, and 2% by mol or less including 0%, of terephthalic acid and/or an ester thereof.

6. The toner according to claim 1, wherein the carboxylic acid component of polyester A does not contain fumaric acid and/or an ester thereof.

7. The toner according to claim 1, wherein the carboxylic acid component of polyester B comprises 50% by mol or more of fumaric acid and/or an ester thereof.

8. The toner according to claim 1, wherein the weight ratio is from 90/10 to 60/40.

9. The toner according to claim 1, wherein the carboxylic acid component of polyester B comprises 90% by mol or more of fumaric acid and/or an ester thereof.

10. The toner according to claim 1, wherein the carboxylic acid component of polyester B does not contain isophthalic acid and/or an ester thereof.

11. The toner according to claim 1, wherein the negatively chargeable charge control agent is contained in an amount of from 1 to 4 parts by weight based on 100 parts of the resin binder.

12. The toner according to claim 1, wherein the weight ratio is from 80/20 to 60/40.

13. The toner according to claim 1, wherein the positively chargeable charge control agent is contained in an amount of from 0.2 to 2 parts by weight based on 100 parts of the resin binder.

14. The toner according to claim 1, wherein the alcohol component comprises an alkylene oxide adduct of bisphenol A represented by the following formula (I):

(I)

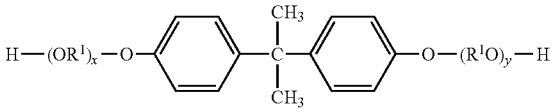

wherein each of $R^1O$ and $OR^1$ is an oxyalkylene group, wherein $R^1$ is an ethylene group and/or a propylene group; x and y are number of moles of alkylene oxides added, each being a positive number, wherein an average of the sum of x and y is from 1 to 16.

15. The toner according to claim 1, wherein the positively chargeable charge control agent comprises a quaternary ammonium salt compound.

* * * * *